US005191184A

United States Patent [19]

Shin

[11] Patent Number: 5,191,184

[45] Date of Patent: Mar. 2, 1993

[54] MICROWAVE WASTE PURIFYING AND INCINERATING APPARATUS

[75] Inventor: Dong-Lyoul Shin, Suwon, Rep. of Korea

[73] Assignee: Samsung Electronics Co., Ltd., Suwon, Rep. of Korea

[21] Appl. No.: 780,467

[22] Filed: Oct. 22, 1991

[30] Foreign Application Priority Data

Oct. 23, 1990 [KR] Rep. of Korea ..... 90-16990

[51] Int. Cl.[5] ..... H05B 6/80; F23G 5/00

[52] U.S. Cl. ..... 219/10.55 R; 219/10.55 B; 110/250; 110/346; 34/1 U

[58] Field of Search ..... 219/10.55 R, 10.55 B, 219/10.55 A, 10.55 F; 110/250, 346; 34/1 P, 1 U, 1 V

[56] References Cited

U.S. PATENT DOCUMENTS 4,718,358 1/1988 Nomi et al. ..... 110/250

4,937,411 6/1990 Suzuki et al. ..... 219/10.55 R

*Primary Examiner*—Philip H. Leung

*Attorney, Agent, or Firm*—Burns, Doane, Swecker & Mathis

[57] ABSTRACT

The present invention relates to a waste purifying and incinerating apparatus, in which the waste matters are introduced into one of a pair of parallel purifying and incinerating chambers provided with a heater and a pair of magnetrons. The waste matters are dried and incinerated by a radiating heat from the heater and a very high frequency generated by the magnetrons, thereby the liquid content retained in the waste and the ashes produced from the incinerating operation are filtered and disinfected as well as the nasty or poisionous components in the gas produced from the incineration is filtered so that antipollution effects and the waste incinerating efficiency are improved.

5 Claims, 3 Drawing Sheets

MICROWAVE WASTE PURIFYING AND INCINERATING APPARATUS

BACKGROUND OF THE INVENTION

1. Field of the Invention

The present invention relates to a waste purifying and incinerating apparatus for purifying and incinerating waste or waste matters discharged from factories and/or homes, more particularly, to a waste purifying and incinerating apparatus having a simple contruction, in which a very high frequency is used for heating waste matters and a purifying and incinerating procedure is automated to increase the operating reliability of the apparatus and to perform a purifying and incinerating function effectively, thereby improving an processing efficiency.

2. Description of the Prior Art

In a well-known waste purifying and incinerating apparatus, waste matters are generally processed through a series of procedures by introducing the waste matters into a purifying and incinerating chamber, drying the introduced waste matters, and then incinerating the dried waste matters.

After the waste matters have been incinerated in the purifying and incinerating chamber, ashes are conventionally removed using a separate suction mechanism such as a vacuum cleaner. In such a manner, however, the following disadvantages in handling and operating of the vacuum cleaner can arise. That is, it is difficult to completely remove the remaining ashes in the chamber with the vacuum cleaner. Also, when remaining sparks of fire which are not extingushied completely are introduced into the vacuum cleaner, it can cause a fire. Further, a filter member mounted in the vacuum cleaner for selectively draining water retained in the waste matters may be frequently choked with minute waste particles, thereby a purifying and incinerating operation of the apparatus can not be executed effectively.

To avoid the aforementioned disadvantages, another method is disclosed in, for example, Japanese Patent Publication No. showa 62-22906, which comprises a processing chamber having a waste introducing inlet and a magnetron mounted thereon, and a combustion chamber connected to the processing chamber, wherein waste matters are dried by a high frequency signal produced by the magnetron and then incinerated therein.

With the arrangement as mentioned above, however, since the processing chamber serves to dry the waste matters with the high frequency signal, it should be provided with a seperate waste transporting means such as a conveyor mechanism for conveying the dried waste matters toward the combustion chamber. As a result, the conventional incinerating apparatus or incinerator is complicated in structure and increased in size.

SUMMARY OF THE INVENTION

Accordingly, the present invention has been made to avoid the afore-mentioned disadvantages and an object of the present invention is to provide a waste purifying and incinerating apparatus which can automatically incinerate waste matters with a simple construction thereof and improve both waste processing efficiency and antipollution, effectively.

In order to achieve the above mentioned object, the present invention provides a waste purifying and incinerating apparatus comprising: a pair of purifying and incinerating chambers arranged parallel to each other having a heater and a pair of magnetrons provided thereon for storing the waste matters introduced and for drying and incinerating the introduced waste matters by using a radiating heat from the heater and a very high frequency generated by the magnetrons, respectively; a passage exchangeable means switched in accordance with a signal supplied from a control means for selectively controlling a pair of introducing passages for the waste matters to be introduced into one of the purifying and incinerating chambers; a filtering means for generating heat by absorbing the very high frequency generated by the magnetrons to further dry and incinerate the waste matters and for passing water retained in the waste matters and ashes produced in incinerating the waste matters; a stirring means rotated by a driving means for grinding the waste matters and for dispersing the very high frequency evenly; a sensor means for sensing an amount of the waste matters loaded within the purifying and incinerating chambers and transferring the sensed signal to the control means; water draining means having a filtering and disinfecting member for filtering and disinfecting the liquid content when the water content and ashes retained in the waste matters are drained; a gas discharging means having a filtering member for filtering and removing a poisonous gas.

The above and other objects, features and advantage of the present invention will become apparent from the following detailed description of an illustrative embodiment thereof to be read in conjunction with the accompanying drawings.

DETAILED DESCRIPTION OF THE PREFERRED EMBODIMENT

A preferred embodiment of the present invention will be now described with reference to the accompanying drawings.

Figure 1:
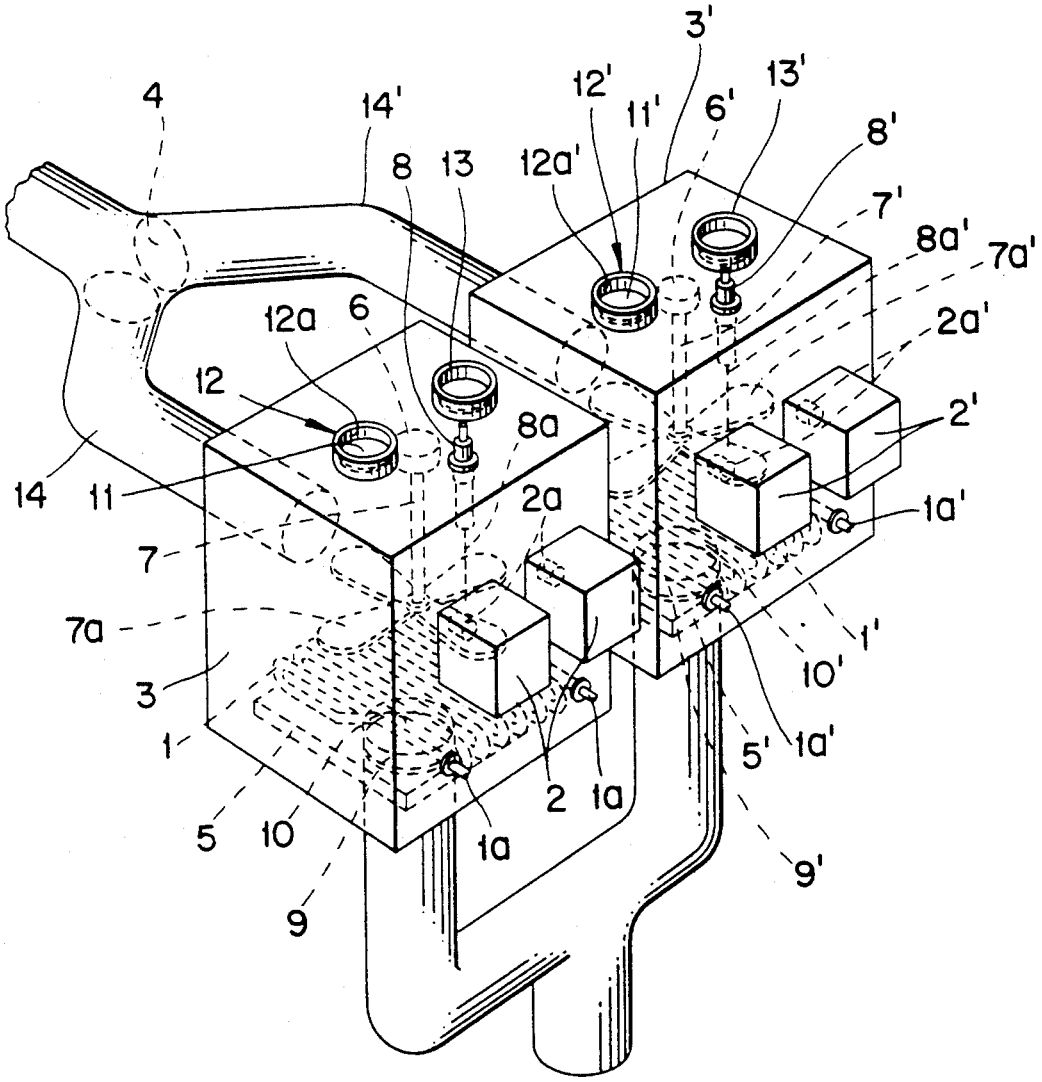
FIG. 1 is a schematic view showing an assembly of the waste purifying and incinerating apparatus according to the present invention.
Figure 2:
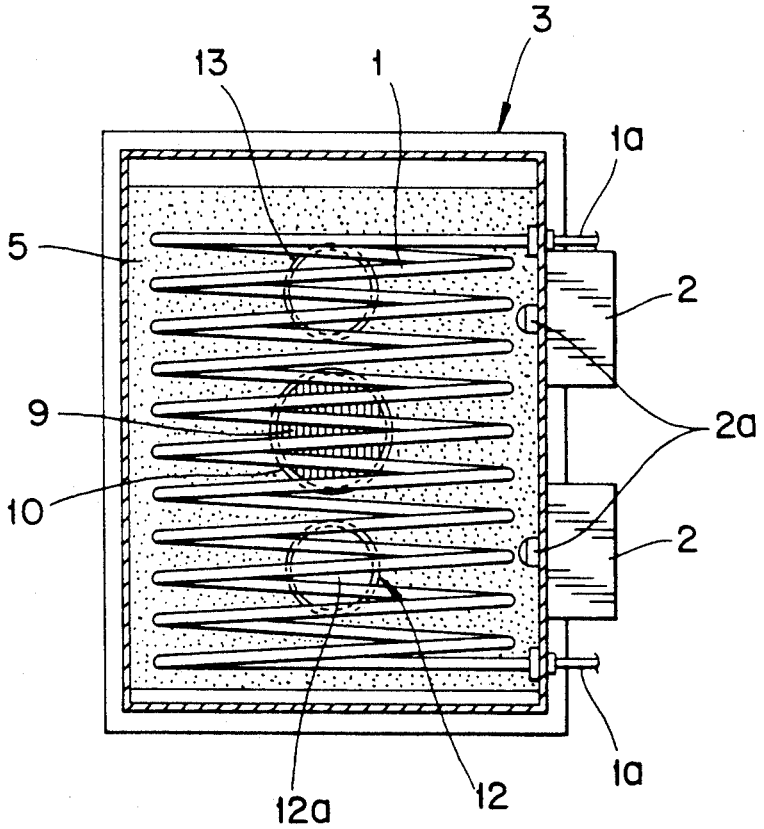
FIG. 2 is a planar cross-sectional view of a waste purifying and incinerating chamber according to an embodiment of the present invention.
Figure 4:
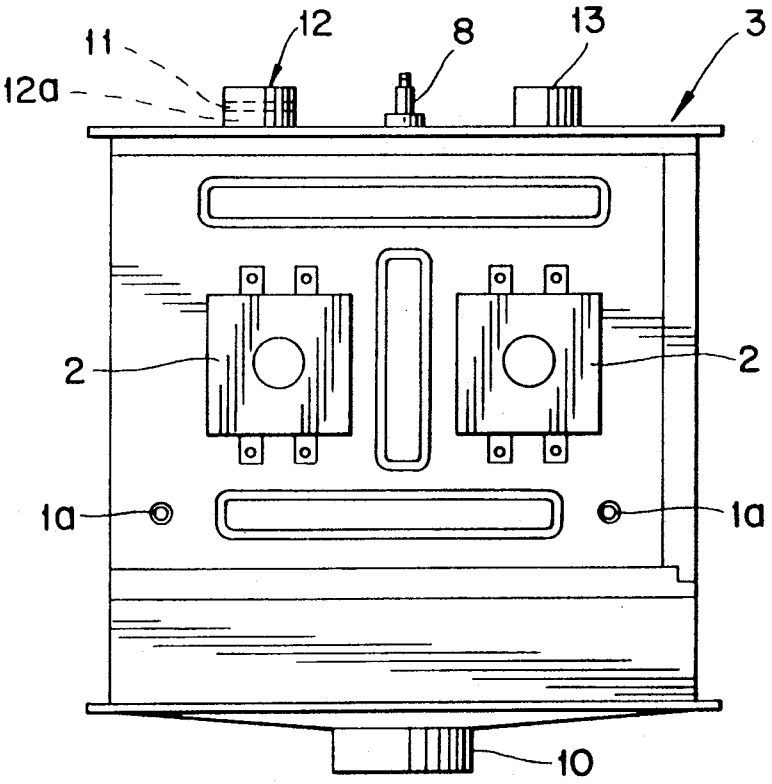
FIG. 4 is a side cross-sectional view of the waste purifying and incinerating chamber shown in FIG. 1.
Figure 3:
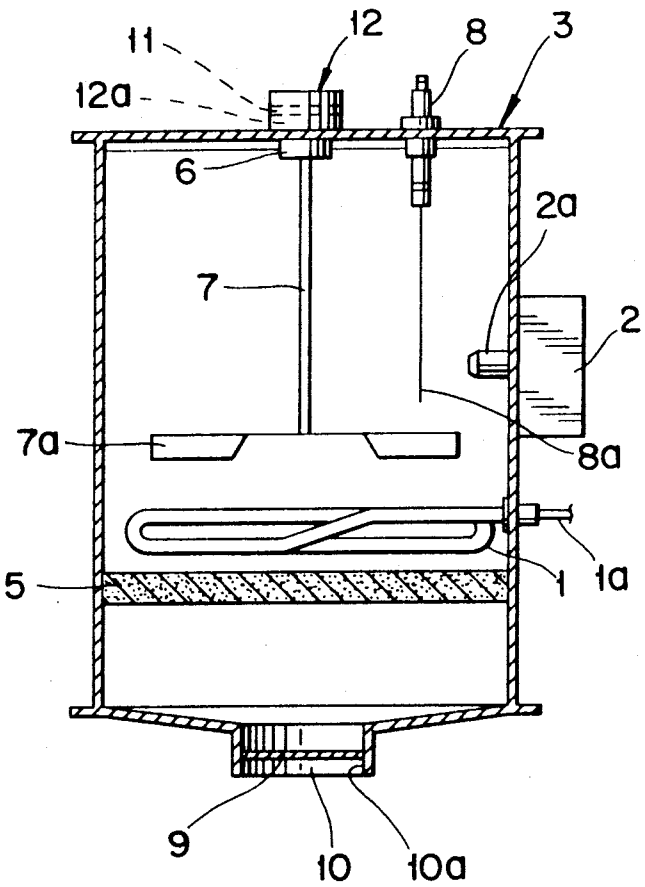
FIG. 3 is a front cross-sectional view of the waste purifying and incinerating chamber shown in FIG. 1.

Referring to FIGS. 1 through 3, there is shown a waste purifying and incinerating apparatus according to the present invention. The apparatus has a pair of purifying and incinerating chambers 3 and 3' which are identical in construction and also arranged parallel with each other to store and incinerate waste matters therein. The chambers 3 and 3' include a pair of coil-shaped heaters 1 and 1' having each terminal 1*a* and 1*a'* 1 transversely mounted in a central area thereof and magnetrons 2 and 2' mounted at a central area of one-side wall of the chambers 3 and 3' for generating a predetermined very high frequency in the range of several gigahertz, respectively. The high frequency generated by the magnetrons 2 and 2' are outputted outwardly through an output terminal 2*a* and 2*a'* projecting into the purifying and incinerating chambers 3 and 3'. The chambers 3 and 3' are further provided with a passage exchangeable means 4 which is switched in accordance with a control signal supplied from a control means (not shown) to selectively convert waste introducing passages 14 or 14' for introducing the waste matters into the purifying and incinerating chamber 3 or 3.' The passage exchangeable means 4 may be formed of, for example, a diaphragm valve or cross valve which is controlled by a solenoid (not shown).

Furthermore, filtering means 5 and 5' are provided on a bottom of the heater 1 and 1', as shown in FIG. 3. The filtering means 5 and 5' are made of materials which absorb a predetermined frequency band of the very high frequency generated by the magnetrons 2 and 2' and generate heat of their own accord. Also the filter means 5 and 5' serve to dry and incinerate the waste matters by the self-generated heat and to filter ashes produced after the waste matter has been incinerated and the water content has been retained in the waste matters. Preferably, the materials which are capable of aborbing the very high frequency to generate heat include a predetermined composition such as $Al_2O_3$, $TiBaO_3$, $Fe_2O_3$ or the like.

Stirring means 7 and 7' are arranged in the inner part of the purifying and incinerating chamber 3 and 3', respectively. The stirring means 7 have a propeller **7*a* and 7*a'* which are rotated by a driving force of a motor 6 to grind the waste matters loaded within the chambers 3 and 3' and disperse the very high frequency within the purifying and incinerating chambers 3 and 3'. Further, sensor means 8 and 8' are having sensing probe 8*a* and 8*a'* sence a stacked height of the waste matters in the chambers 3 and 3' and transfer the sensed signal to the control means which is disposed in the vicinity of the stirring means 7 and 7', respectively. The sensor means 8 and 8' are constructed such that they output the sensed signal by using a electromotive force generated due to contact of a top end of respective sensing probe 8*a* and 8*a'*** with the water content retained in the waste matters.

Moreover, water draining means 10 and 10' are provided on the bottom of the respective chambers 3 and 3' near the lower side of the filtering means 5 and 5', respectively, as shown in FIG. 2. The water draining means 10 and 10' are provided with filtering and disinfecting members 9 and 9' which are arranged within water draining outlet **10*a* and 10*a'* and serve to filter and disinfect solid particles of a liquid component when the liquid component and the carbonized ashes are discharged outwardly, respectively. In addition, gas discharging means 12 and 12' having gas filtering member 11 and 11' mounted in an outlet 12*a* and 12*a'* are provided on an upper side of the chamber, 3 and 3, respectively. The gas filtering member 11 and 11' are made of activated carbon or a platinum catalytic filter for removing a poisonous gas, respectively. Moreover, air introducing inlets 13 and 13' are disposed in the vicinity of the gas discharging means 12 and 12'** so as to introduce the ambient air necessary for combustion of the dried waste matters, respectively.

Now, operation and effect of the waste purifying and incinerating apparatus constructed as mentioned above will be described in detail.

As shown is FIG. 1, under a condition that the power supply is applied to the purifying and incinerating chambers 3 and 3', if the waste matters are introduced through waste introducing passages 14 and 14', the passage exchangeable means 4 is switched to introduce the waste matters into the purifying and incinerating chamber 3 or 3' under control of the control means (not shown) depending on the sensed signal supplied from the sensor means 8 or 8'.

Here, assume one purifying and incinerating chamber 3 of this invention, for example, is empty for processing the waste matters, and the other chamber 3' is in the process or shut down. In this case, since the waste matters are not sensed by means of the sensor means 8' arranged in the purifying and incinerating chamber 3', the passage exchangeable means 4 is controlled by the control signal from the control means (not shown) to close the waste introducing passage 14' of the purifying and incinerating chamber 3' and to open the waste introducing passage 14, as shown in FIG. 1 in dotted lines, thereby the waste matters can be introduced into the purifying and incinerating chamber 3 through the opened waste introducing passage 14.

The waste matters thus introduced into the chamber 3 are stacked on the filtering means 5. At this time, the liquid components such as water content retained in the waste matters fall downwardly by gravity through the filtering means 5. When the waste matters are stacked to a certain height on the filtering means 5 and contact the sensing poobe **8*a*, the sensor means 8 transfers the sensed signal to the control means and thus the power supply is supplied to the heater 1, magnetron 2 and motor 6** in accordance with a control signal from the control means so that they are operated.

Accordingly, the waste matters are stirred and collide with the propeller **7*a* which is rotated by the motor 6 to be dispersed or ground evenly within the chamber 3. Simultaneously, the waste matters are heated and dried by the very high frequency generated by the magnetron 2 and evenly dispersed into an internal space of the chamber 3 in accordance with the stirring operation of the stirring means 7. The waste matters thus dried are incinerated completely with the high radiating heat from the heater 1 and the radiating heat of the filtering means 5 which absorbs the very high frequency and generates heat of its own accord. In this case, the temperature of heat generated by the filtering means 5 is generally equal to that of the heat generated by the heater 1**.

Meanwhile, the liquid components such as water content gravitate from the waste matters stacked on the filtering means 5 and drop down passing through the filtering means 5. Thereafter, the solid particles remaining in the liquid components filtered by the filtering are means 5 and are further filtered out and disinfected by means of the filtering and disinfecting member 9 which is provided in the water draining means 10. The filtering and disinfecting member 9 includes an ozonizer and a sand filter filled with sands. The liquid components thus filtered and disinfected are then discharged to the outside of the chamber 3 through a discharging outlet **10*a*** so as to be drained by public drainage system or reused in industrial irrigation system.

Moreover, the air necessary to incinerate the waste matters is introduced through the air introducing inlet 13 mounted on the upper portion of the chamber 3. Alternatively, gas produced in the incinerating operation of the waste matters is discharged outwardly through the gas discharging means 12. Since the gas discharging means 12 is provided with the gas filtering member 11 made of activated carbon or a platinum catalytic filter, a nasty smell, solid particles and/or poisonous gas components contained in the gas to be discharged are filtered and removed, and thus a relatively clean gas is discharged into the atmosphere, by this time, ashes produced at the incineration of the waste matters are washed out and discharged together with water content contained in the newly introduced waste matters which are subject to a sequential purifying and incinerating operation. They are discharged to the water draining means 10 by passing through the filtering means 5.

In this case, the liquid components such as the water content and the solid particles such as ashes are filtered and disinfected by means of the filtering and disinfecting member 9 mounted in the water draining means 10, thereby the purified water is discharged through the water draining means 10. The purified water is good in quality, and it can be utilized in an industrial irrigation system or it can be discharged to a drainage.

While the waste matters are incinerated in the purifying and incinerating chamber 3 as described above, the remaining chamber 3' is not operated. When a predetermined time sufficient to complete the incineration operation of the waste matters dried by the heat from the heater 1 whithin the chamber 3 has elapsed, the control signal from the control means is supplied to the passage exchangeable means 4. As a result, the passage exchangeable means 4 is switched to close the waste introducing passage 14 of the chamber 3 and to open the waste introducing passage 14' of the chamber 3'. Therefore, the waste matters are introduced into the empty chamber 3' through the waste introducing passage 14' and processed in the same manner as described above, that is, a series of procedures for drying and incinerating the waste matters by using the very high frequency from the magnetrons 2' and the high radiating heat from the heater 1' are sequentially executed.

Thereafter, if the waste matters have been completely processed in the chamber 3', the chamber 3 again starts to process the waste matters. By this way, the purifying and incinerating chamber pair 3 and 3' are operated alternatively to purify and incinerate the waste matters, in turn.

Although the preferred embodiment of the present invention has been described with reference to the accompanying drawings, it is to be understood that the invention is not limited to the precise embodiment and that various changes and modifications thereof could be effected by one skilled in the art without departing from the spirit or scope of the concepts of the invention. That is, a diaphragm valve forming the passage exchangeable means 4 may be replaced with a three way valve. Further, if the water content to be discharged is purified in a range within an allowable environmental regulation, the filtering and disinfecting members 9 and 9' arranged in the water draining means 10 and 10' can be removed. Of course, one purifying and incinerating chamber 3 or 3', may be installed or a plurality of the purifying and incinerating chamber pair 3 and 3' may be arranged depending on the amount of the waste matter to be processed, and the incinerating chambers may be connected with each other by means of the waste introducing passages 14 and 14' to thereby form a large-scale waste processing system.

As described above, the waste purifying and incinerating apparatus according to the present invention can automatically perform a series of processing procedures for drying and incinerating various waste matters discharged from factories and/or homes in the purifying and incinerating chambers by using the very high frequency from the magnetrons and the radiating heat from the heaters. The present invention incinerates solid particles retained on the filtering means after the incineration of the waste matters and discharges the particles together with the water content the present invention purifies and removes poisonous gas to be discharged, thereby overcoming problems of the conventional waste purifying and incinerating apparatus. Therefore, according to the waste purifying and incinerating apparatus of the present invention, both antipollution effects and waste processing efficiency can be improved considerably.

What is claimed is:

1. A waste purifying and incinerating apparatus comprising:

a pair of purifying and incinerating chambers, arranged parallel to each other and having a heater and a pair of magnetrons provided thereon, for storing the waste matters introduced and for drying and incinerating the introduced waste matters by using a radiating heat from said heater and a very high frequency generated by said magnetrons, respectively;

a passage exchangeable means switched in accordance with a control signal supplied from a control means for selectively controlling a pair of introducing passages for the waste matters introduced into said purifying and incinerating chambers;

a filtering means for generating heat by absorbing the very high frequency generated by said magnetron to further dry and incinerate the waste matters and for passing a liquid content and ashes produced by incinerating the waste matters;

a stirring means rotated by a driving means for grinding the waste matters and for dispersing the very high frequency evenly in said chambers;

a sensor means for sensing an amount of the waste matters introduced into said purifying and incinerating chambers and transferring the sensed signal to said control means;

a water draining means having a filtering and disinfecting member for filtering and disinfecting said liquid content when a water content and ashes retained in the waste matters are drained;

a gas discharging means having a gas filtering member for filtering and removing poisonous gas.

2. The waste purifying and incinerating apparatus according to claim 1, wherein said passage exchangeable means is formed with a three way valve which is controlled by means of a solenoid.

3. The waste purifying and incinerating apparatus according to claim 1, wherein said passage exchangeable means is formed with a diaphragm valve.

4. The waste purifying and incinerating apparatus according to claim 1, wherein said filtering means are made of a composition such as $Al_2O_3$, $TiBaO_3$ or $Fe_2O_3$, respectively.

5. The waste purifying and incinerating apparatus according to claim 1, wherein said gas filtering means are formed with activated carbon or a platinum catalytic filter, respectively.

* * * * *